US005197232A

United States Patent [19]

Ellestad

[11] Patent Number: 5,197,232

[45] Date of Patent: Mar. 30, 1993

[54] UNIVERSAL SHARPENER FOR ICE SKATES

[76] Inventor: Everett M. Ellestad, Grönviksvägen 107, S-161 40, Bromma, Sweden

[21] Appl. No.: 769,189

[22] Filed: Sep. 30, 1991

[30] Foreign Application Priority Data

Oct. 9, 1990 [SE] Sweden ..... 9003211-1

[51] Int. Cl.[5] ..... B24D 15/00

[52] U.S. Cl. ..... 51/205 WG; 51/391; 76/83

[58] Field of Search ..... 51/205 R, 205 WG, 214, 51/285, 208, 358, 391, 392, 393, 228, 62, 150, 394, 407, 381, 241 G, 173; 76/83, 82, 82.2

[56] References Cited

U.S. PATENT DOCUMENTS

| | | | |
|---|---|---|---|
| 661,282 | 11/1900 | Bachman | 51/381 |
| 1,045,201 | 11/1912 | Shoop | 51/381 |
| 1,672,547 | 6/1928 | Swartz | 76/83 |
| 1,883,747 | 10/1932 | Maddox | 51/381 |
| 2,032,640 | 3/1936 | Swetta et al. | 76/83 |
| 2,054,495 | 9/1936 | Corkum | 51/205 WG |
| 2,542,281 | 2/1951 | Lefteruk | 51/205 WG |
| 2,550,765 | 5/1951 | Brown | 76/83 |
| 4,219,975 | 9/1980 | Scholler | 51/205 WG |
| 4,815,240 | 3/1989 | Larson | 51/205 WG |
| 4,908,994 | 3/1990 | Fraser | 51/208 |
| 4,910,923 | 3/1990 | McCabe | 51/205 WG |

FOREIGN PATENT DOCUMENTS

| | | | |
|---|---|---|---|
| 158902 | 2/1933 | Fed. Rep. of Germany | 76/83 |
| 0048265 | 3/1985 | Japan | 51/392 |
| 62469 | 4/1985 | Japan | 51/392 |
| 257776 | 11/1986 | Japan | 51/394 |

*Primary Examiner*—Bruce M. Kisliuk
*Assistant Examiner*—Bryan Reichenbach
*Attorney, Agent, or Firm*—Joseph S. Heino

[57] ABSTRACT

A small sharpening device for ice skates that is intended to be carried in a person's pocket, which can be adjusted to fit and to sharpen all existing ice skates having either concave or flat-ground blades. The sharpener has two side pieces that form a gap to fit around the ice skate blade and a central flexible grinding cylinder that as the sharpener is moved back and forth along the skate blade adjusts to and sharpens either concave shaped blades or flat-ground blades. The round central cylinder can be replaced when worn out or when a polygon shaped grinding cylinder is required for certain flat-ground blades. The adjustable, parallel sides prevent the sharpener from rocking from side to side as the device is moved back and forth along the blade.

3 Claims, 2 Drawing Sheets

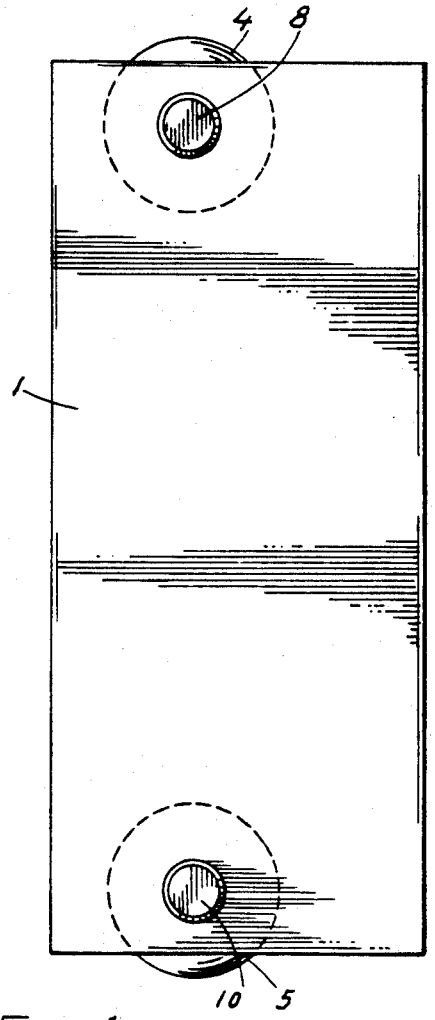
FIG. 1.
FIG. 2.
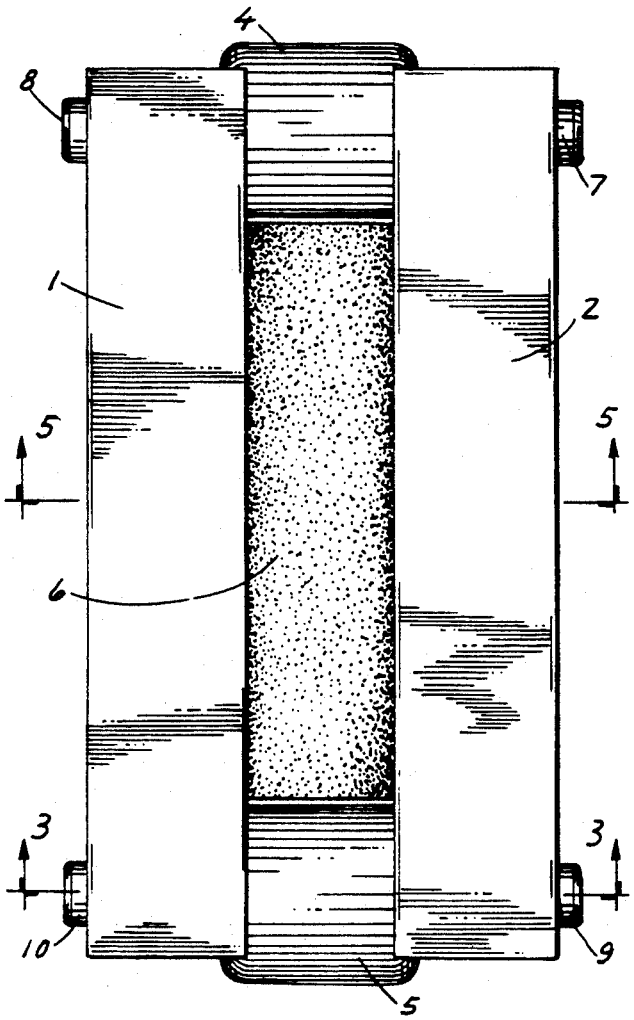
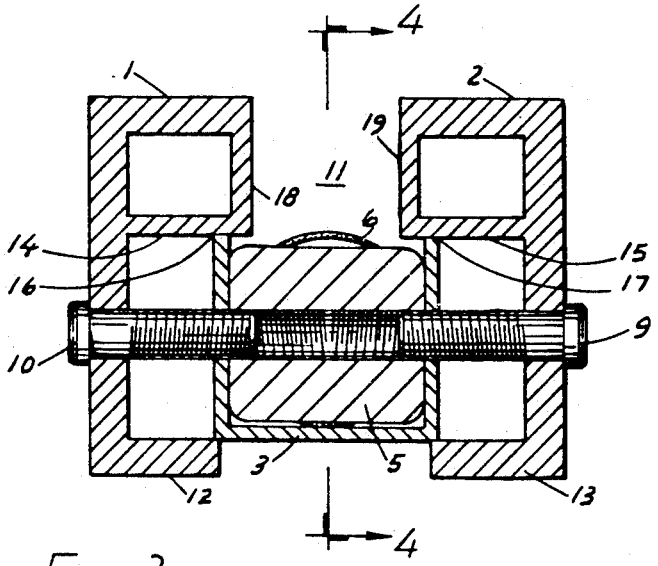
FIG. 3.

UNIVERSAL SHARPENER FOR ICE SKATES

FIELD OF THE INVENTION

This invention relates generally to sharpening tools or devices and more particularly to a small hand-held adjustable sharpening device for ice skate blades.

The sharpener of the present invention is intended to be carried in a person's pocket, is adjusted by means of small rotatable knobs or other suitable means, and eliminates the need for any additional tools to fit and sharpen all available types and sizes of ice skates having either concave-ground or flat-ground blades. The sharpener has two side pieces that form a gap for inserting the ice skate blade therebetween. The side pieces serve as guides to control the lateral movement of the sharpener as the flexible hollow grinding device, which is placed at the center of the skate sharpener and which forms itself to the concavity of the blade, is drawn by hand back and forth longitudinally along the length of the blade.

BACKGROUND OF THE INVENTION

Both adjustable and non-adjustable hand-held ice skate blade sharpeners are known. For an example of such sharpeners, see U.S. Pat. No. 4,910,923 to McCabe, U.S. Pat. No. 4,908,994 to Fraser and U.S. Pat. No. 4,815,240 to Larson. Such sharpeners have removable or fixed grinding surfaces at the bottom of a movable or fixed gap or opening formed by solid side pieces.

One of the disadvantages inherent in the design of these known sharpeners is that the width of the gap cannot be easily or correctly adjusted for the many and varied blade widths of existing ice skates which are available. The result is that the sharpener will either not fit a skate blade properly or it will tend to rock excessively from side to side as the sharpener is moved back and forth along thin blades.

A second disadvantage is that the grinding surfaces of the known sharpeners are not flexible and are either difficult or impossible to rotate or replace once they become worn, which can be quite rapid.

A further important disadvantage inherent in the design of the known sharpeners is that they are intended for a few ice skate models only, which not only may also have varying widths per se, but also have concave ground blades differing from other skates. Figure skates, for example, have wider, shallower ground blades. Modern long-distance skates such as the kind worn on ski boots, on the other hand, are not concave ground at all and have blades as narrow as 1.4 mm. The grinding device must therefore be either replaceable or adjustable for many different skates, or both.

SUMMARY OF THE INVENTION

It is, therefore, a principal object of this invention to provide a new, useful and uncomplicated ice skate blade sharpener that eliminates all of the disadvantages of the known sharpeners, and does so without the need for any extra tools.

The sharpener of the present invention has obtained these objects. The skate sharpener according to the present invention has, among others, the following advantages as compared with the known skate sharpeners. It is very small, compact and light in weight. It can be variably adjusted for skate blades having different widths by moving the side pieces uniformly and simultaneously inward or outward without the need of tools.

The sharpener of the present invention is provided with a central grinding device in the form of a flexible hollow cylinder which can be rotated or replaced once it becomes worn. More importantly, the flexible hollow cylinder can be deformed sufficiently under light pressure to adapt to the varying concave blade edge surfaces of different skate types. The flexible hollow cylinder can also be replaced by a rigid polygon-shaped element having flat sides for sharpening conventional wide flat-ground blades. The entire sharpener is small enough to carry in one's pocket without any difficulty.

The foregoing and other features of the sharpener of the present invention will be further apparent from the description which follows.

BRIEF DESCRIPTION OF THE DRAWINGS

FIG. 1 is a side elevational view of the skate sharpener of the present invention.

FIG. 2 is a top plan view of the sharpener shown in FIG. 1.

FIG. 3 is a front cross-sectional view of the sharpener taken along line 3—3 of FIG. 2.

DETAILED DESCRIPTION

Figure 4:
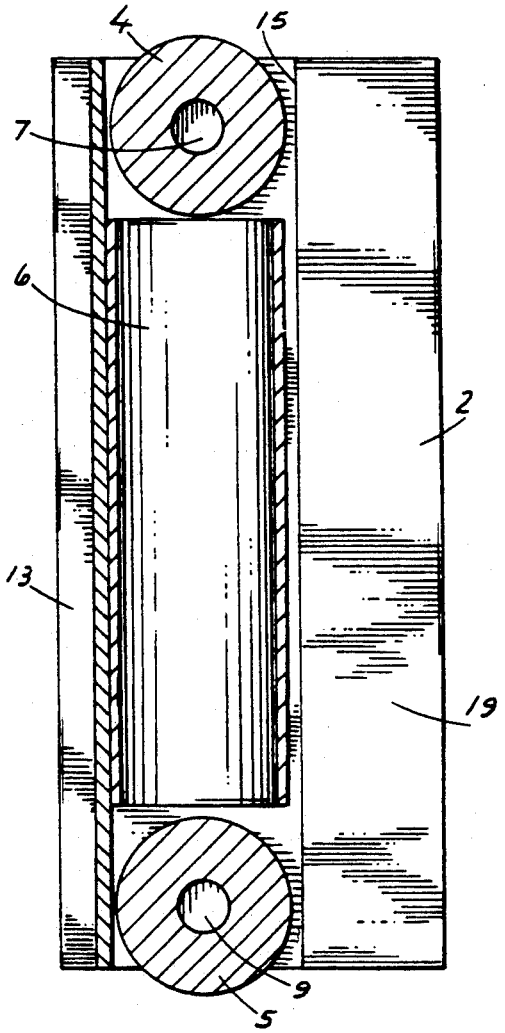
FIG. 4 is a side cross-sectional view taken along line 4—4 of FIG. 3.

Reference is now made more particularly to the drawings and particularly to FIGS. 1 and 2 which show an ice skate sharpener constructed in accordance with the present invention. The sharpener comprises two side pieces 1, 2 which are attached to a holder 3 containing a grinding element 6 by two screws 7, 8 and 9, 10 and two rotatable adjustment knobs 4, 5. The holder 3 consists of a U-shaped extrusion with a top and side walls. See FIG. 3.

The grinding element 6 is a flexible hollow cylinder or a rigid hollow polygon **6*a* which lies loosely between the walls of the holder 3. The cylindrical grinding element 6 can be deformed sufficiently to adapt to the varying concave blade edge surfaces of the many different skate types available. The polygonal grinding element 6*a*** provides a flat surface for skate blades that are flat ground. Optimal flexibility in the case of the grinding cylinder has been found by using a 1 mm. thick plastic tube.

The two adjusting knobs 4, 5 are allowed to rotate on screws 7, 8 and 9, 10, respectively, which are fixed in the side pieces 1, 2. The screws 7, 8 are threaded left-hand and right-hand in pairs so that turning the knobs 4, 5 will simultaneously and uniformly move the side pieces 1, 2 apart or together, respectively, thereby causing the width of the gap 11 between the side pieces to change. In this configuration, the side pieces 1, 2 are always the same distance from the center of the device, thereby insuring that the gap 11 will always be centered above the grinding element 6. The knobs 4, 5 are easy to turn with a finger.

The side pieces 1, 2 can be moved apart far enough to allow the insertion of a finger to rotate the cylindrical grinding element 6 and bring forth a fresh grinding surface. The gap 11 can also be opened wide enough to completely remove and replace the grinding element 6 from the sharpener when such is required or desired.

Figure 5:
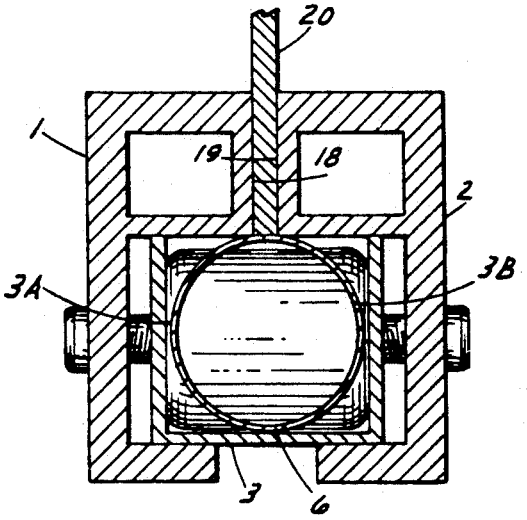
FIG. 5 is another front cross-sectional view taken along line 5—5 of FIG. 2 and illustrating a cylindrical grinding element for sharpening concave skate blades.

Each side piece 1, 2 has a top flange 12, 13, respectively, that glides along the top of the holder 3. The side pieces also have bottom walls 18, 19 that form the sides of the gap 11 and serve to guide the skate blade 20 inserted therebetween. See FIG. 5. The cylindrical grinding element 6 lies in the holder 3 between the side walls 3A, 3B and is centered relative to the guiding sides 18, 19 that form the sides of the gap 11 and guide the skate blade 20.

The grinding element 6 lies in the holder 3 between the side walls 3A, 3B. The knobs 4, 5 also lie with a small degree of play between the side walls of the holder by screws 7, 8 and 9, 10, which are fixed in the side pieces 1, 2. The grinding element 6 will thus always be in the correct parallel position relative to the edges of the skate blade 20.

Figure 6:
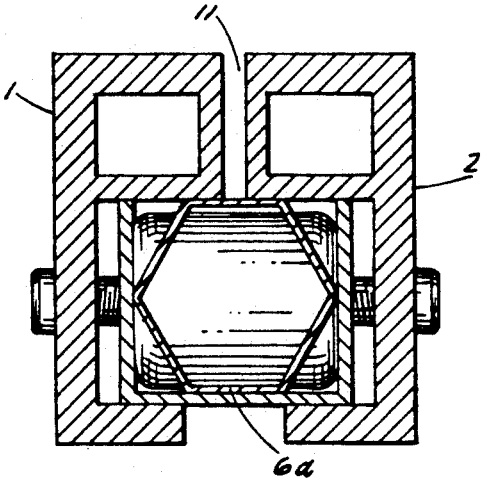
FIG. 6 is a view similar to FIG. 5 but showing an alternative embodiment of the present invention and illustrating a polygon-shaped grinding element for sharpening flat-ground skate blades.

In FIG. 6, a grinding element 6*a* having a polygon shape for sharpening certain types of flat-ground skate blades is shown in an alternative embodiment.

In application, the skate blade 20 is placed within the gap 11 which exists between the sharpener side pieces 1, 2. The knobs 4, 5 are rotated sufficiently to close the gap 11 to the point where the blade 20 can freely move only longitudinally along the grinding element 6. The sharpener is then drawn back and forth across the skate blade 20 such that the flexible grinding element 6 is resiliently compressed to conform to and sharpen the concave surface of the blade 20.

From the foregoing detailed description of the illustrative embodiments of the invention set forth herein, it will be apparent that there has been provided a new, useful and uncomplicated ice skate blade sharpener which can be variably adjusted for skate blades having different widths, which can sharpen various concave and flat blade edge surfaces and which does not require the use of any additional tools.

The principles of this invention having been fully explained in connection with the foregoing, I hereby claim as my invention:

1. A skate blade sharpener which comprises skate blade access means, means for adjusting said access means to allow access for blades of various thicknesses, and skate blade sharpening means, said skate blade sharpening means includes a hollow sharpening element situated within said blade access means, said hollow sharpening element comprises a flexible hollow sharpening cylinder having an abrasive outer surface and being functionally adapted to sharpen a skate blade drawn across said outer surface, said access adjustment means includes two generally parallel side elements and said access means comprises a longitudinally extending opening to the hollow sharpening element defined between said side elements, said side elements further being functionally adapted to be uniformly and simultaneously movable away from and toward each other by means of two manually rotatable knobs situated between and connected to each of the side elements to widen or narrow, respectively, the opening defined therebetween.

2. A device for sharpening a skate blade, said skate blade having a concave surface situated between two generally parallel side walls, which comprises skate blade sharpening means, said skate blade sharpening means including a flexible hollow sharpening cylinder, said hollow sharpening cylinder having an abrasive outer surface and being functionally adapted to conform to the shape of said concave skate blade surface, skate blade guide mans, said skate blade guide means including two generally parallel and movable side elements functionally adapted to guide the parallel side walls of aid skate blade therebetween, and mean for variably adjusting said guide means to allow for the sharpening of blades of various thicknesses, said adjusting means including two manually rotatable knobs connected to said side elements and being functionally adapted to move said side elements simultaneously and uniformly way from and toward each other.

3. An ice skate blade sharpener comprising two generally parallel and longitudinally extending side pieces, aid side pieces being functionally adapted to form a longitudinally extending gap to receive an ice skate blade therebetween and to serve as guides when the sharpener is drawn along the ice skate blade, a hollow grinding element, said hollow grinding element comprises a flexible hollow grinding cylinder having an abrasive outer surface, a longitudinally extending holder for retaining the grinding element therewithin, said holder being located within the sharpener and being so situated in relation to the longitudinally extending gap formed between the two side pieces such that the grinding element outer surface may be accessed by a skate blade situated within the gap when the grinding element is placed within the gap when the grinding element is placed within the holder, and means for simultaneously and uniformly moving the side pieces toward and away from each other to narrow or widen, respectively, the gap formed therebetween, said moving means including two manually rotatable knobs connected to each of the side pieces to widen or narrow the gap formed between the side pieces when the adjusting knobs are rotated.

* * * * *